US005921630A

United States Patent [19]

Cassaday

[11] Patent Number: 5,921,630

[45] Date of Patent: Jul. 13, 1999

[54] HEIGHT ADJUSTMENT MECHANISM FOR A BACK REST OR AN ARM REST OF A CHAIR

[76] Inventor: Terrence Joseph Cassaday, 306 Vesta Drive, Toronto, Ontario, Canada, M5P 3A3

[21] Appl. No.: 08/870,316

[22] Filed: Jun. 6, 1997

[51] Int. Cl.[6] ..... B60N 2/02

[52] U.S. Cl. ..... 297/353; 297/411.36

[58] Field of Search ..... 297/338, 344.12, 297/353, 410, 411.36; 248/118.3, 125.1, 125.8, 161, 407, 157

[56] References Cited

U.S. PATENT DOCUMENTS 4,674,798 6/1987 Oeth et al. ..... 297/411.36
5,382,077 1/1995 Stumpf et al. ..... 297/353
5,405,189 4/1995 Stumpf ..... 297/353
5,551,754 9/1996 Neumueller ..... 297/353

*Primary Examiner*—Milton Nelson, Jr.

[57] ABSTRACT

A chair has a mechanism for adjusting height of a component, i.e. a back rest or an arm rest of the chair. The mechanism comprises a vertically extending rail, a rail grip and a rotatable control member having an orbital portion which orbits about the axis of rotation of the control member. The control member rotates to orbit the orbital portion between a release position where the rail and rail grip are slideable relative to one another to adjust the height of the chair component and a locking position where the orbital portion of the control member pushes the rail and rail grip into locking engagement with one another preventing height adjustment of the chair component.

7 Claims, 8 Drawing Sheets

HEIGHT ADJUSTMENT MECHANISM FOR A BACK REST OR AN ARM REST OF A CHAIR

FIELD OF THE INVENTION

The present invention relates to a height adjustment mechanism for a back rest or an arm rest of a chair.

BACKGROUND OF THE INVENTION

Back rest and arm rest height adjustments for chairs are known. Some of these adjustments are only settable at discrete locations within the range of movement of the back rest or arm rest. Other adjustments provide essentially an infinite number of positions in a range of movement of the chair component, but are cumbersome to use. For example, a threaded shaft provides non-discrete adjustment of a chair back rest but requires turning an adjustment nut through a large number of revolutions to move the back rest. Other arrangements use a slotted support having locking nuts which must be loosened and tightened for each adjustment of the chair.

U.S. Pat. No. 4,536,031 for a back support control mechanism for a chair or the like describes a mechanism used to adjust the position of a chair back rest through an essentially infinite number of positions within the range of movement of the back rest. According to the patent a channel member attached to the chair seat cooperates with a bar attached to the back rest to allow adjustment of the back rest position. To lock the position of the back rest a pressure pad attached to the bar is biased against the channel member by a movable lever.

The chair of the above patent, although workable, comprises numerous parts including a pressure pad and a spring system which substantially increase the manufacturing complexity and the risk of breakage of the parts.

SUMMARY OF THE INVENTION

The present invention provides a chair having a mechanism for adjusting height of either the back rest or the arm rest of the chair. The mechanism provides a simple efficient height adjustment without requiring numerous complex components in the mechanism.

More particularly, the height adjustment mechanism of the present invention comprises a vertically extending rail, a rail grip and a rotatable control member. The control member has an orbital portion which upon rotation of the control member moves between a release position where the rail and rail grip are slideable relative to one another for adjusting height of the chair component and a locking position where the orbital portion of the control member pushes the rail and rail grip into locking engagement and prevents height adjustment of the chair component.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
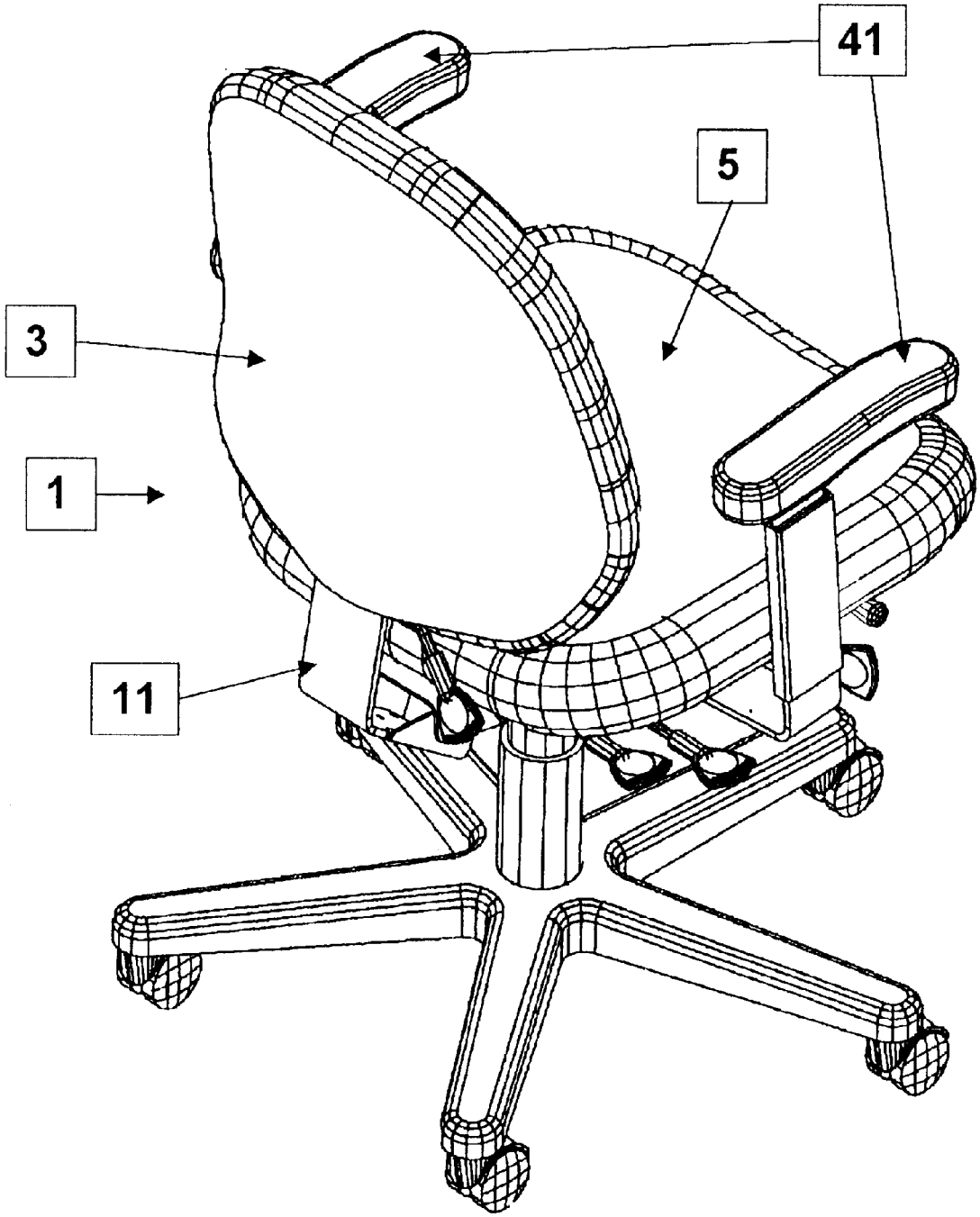
FIG. 1 is a perspective view of a chair including height adjustment mechanisms at both the back rest and the arm rests of the chair in accordance with preferred embodiments of the present invention.

FIG. 1 shows a chair generally indicated at 1. This chair includes a back rest 3 which is height adjustably secured to a seat rest 5. It also includes a pair of height adjustable arm rests 41.

Figure 2:
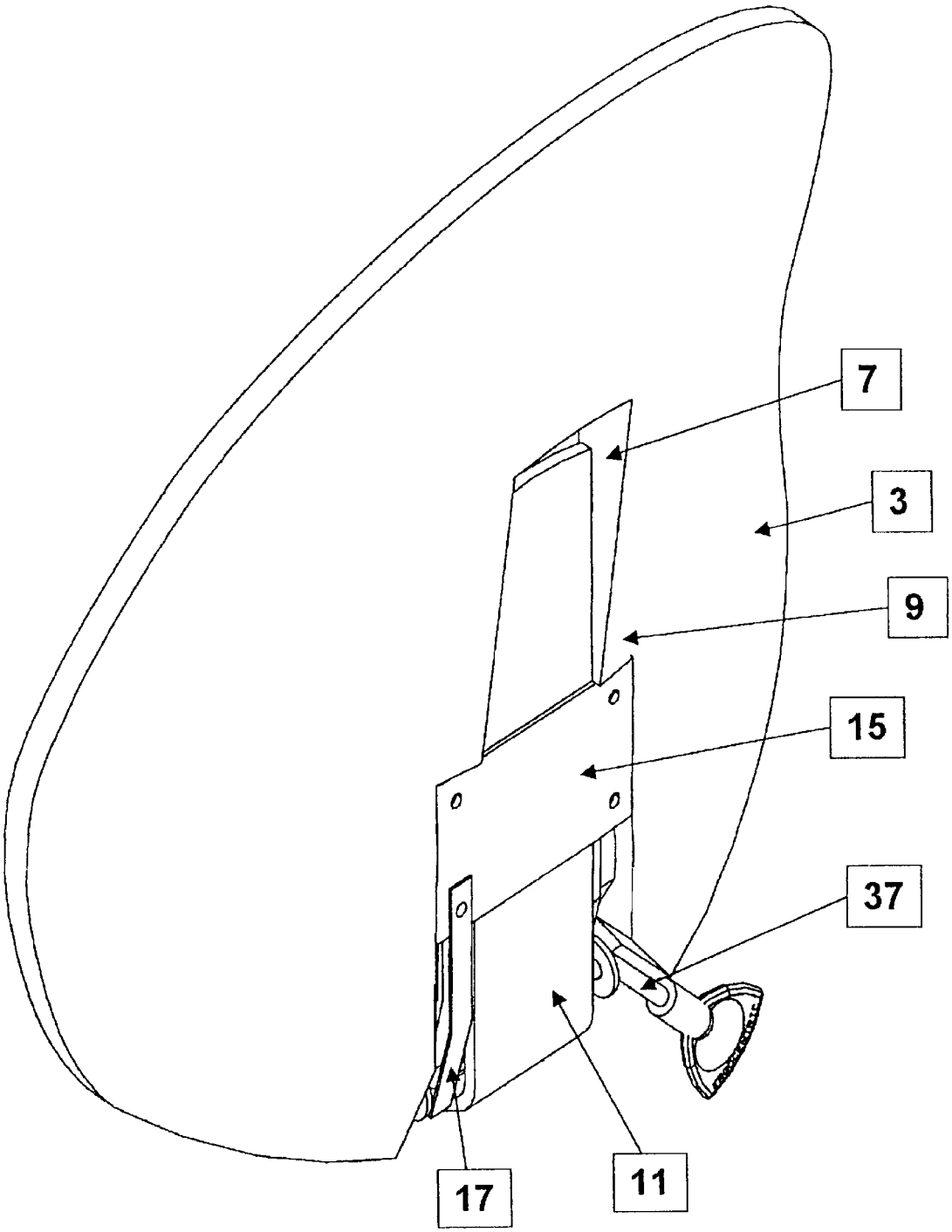
FIG. 2 is a rear perspective view of the back rest of the chair of FIG. 1.
Figure 3:
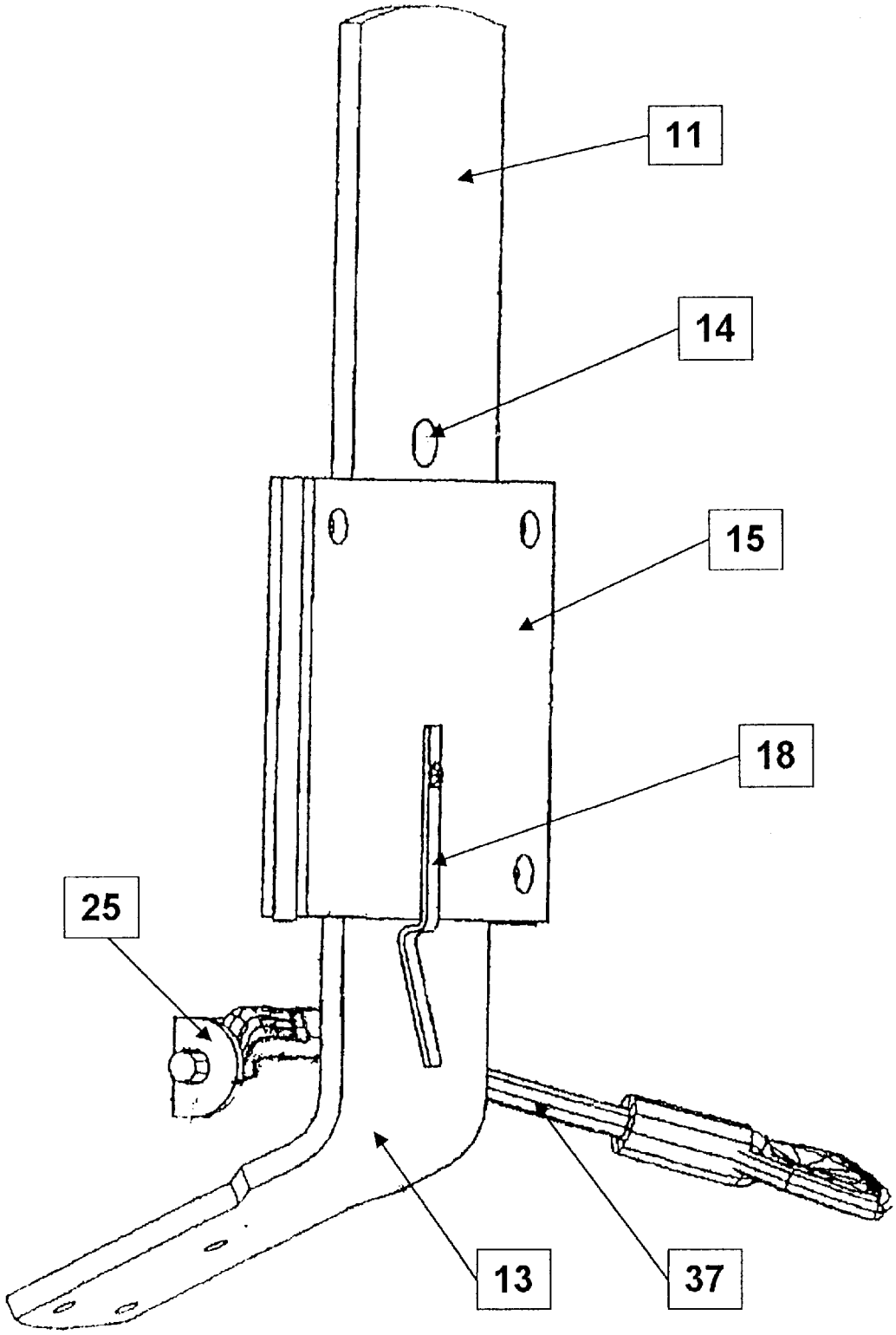
FIG. 3 is a perspective view of the back rest height adjustment mechanism of FIGS. 1 and 2.

FIG. 2 shows the back rest 3 before upholstering and removed from the rest of the chair. As will be seen, the back rest includes a central slot 7 which houses the vertically extending part of a rail 11. The base 13 of the rail is bent forwardly as seen in FIG. 3 to secure to the underside of the seat 5. Therefore, in this particular case, the rail is fixed and the seat back 3 is adjustable in height relative to the rail.

Secured to the seat back across the slot 7 is a rail collar generally indicated at 15. This rail collar is sleeved over the rail 11.

Figure 4:
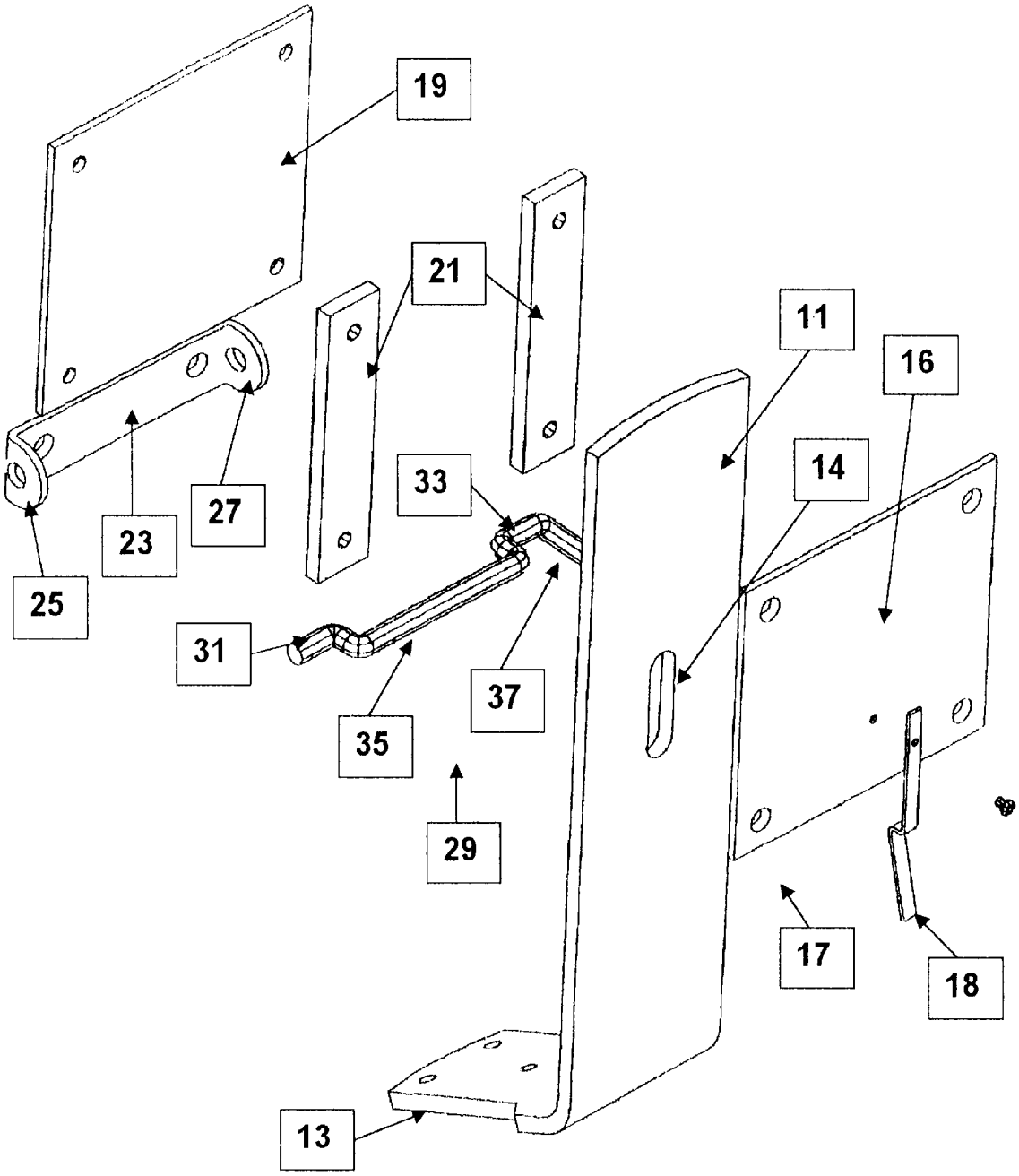
FIG. 4 is an exploded perspective view of the back rest height adjustment mechanism of FIG. 3.

As seen in FIG. 4, the rail collar comprises a rear face 16 with a flexible stop 18 secured to the back of the rear face 16 of the collar.

The collar further includes a front face 19 which is secured in spaced relationship to the rear collar face 16 by side connectors 21.

A bracket 23 is also secured to the seat back directly beneath the front collar face 19. This bracket has rearwardly turned end portions 25 and 27.

The control member generally indicated at 29 has a pair of shaft portions 31 and 33 rotatably secured within the end portions 25 and 27 respectively of the bracket 23. The control member further includes an orbital portion 35 between its rotatable shaft portions 31 and 33. Extending outwardly from the end of the control member is a control handle 37 which is used to rotate the control member and to orbit the orbital portion between a release and a locking position as described below.

Figure 3A:
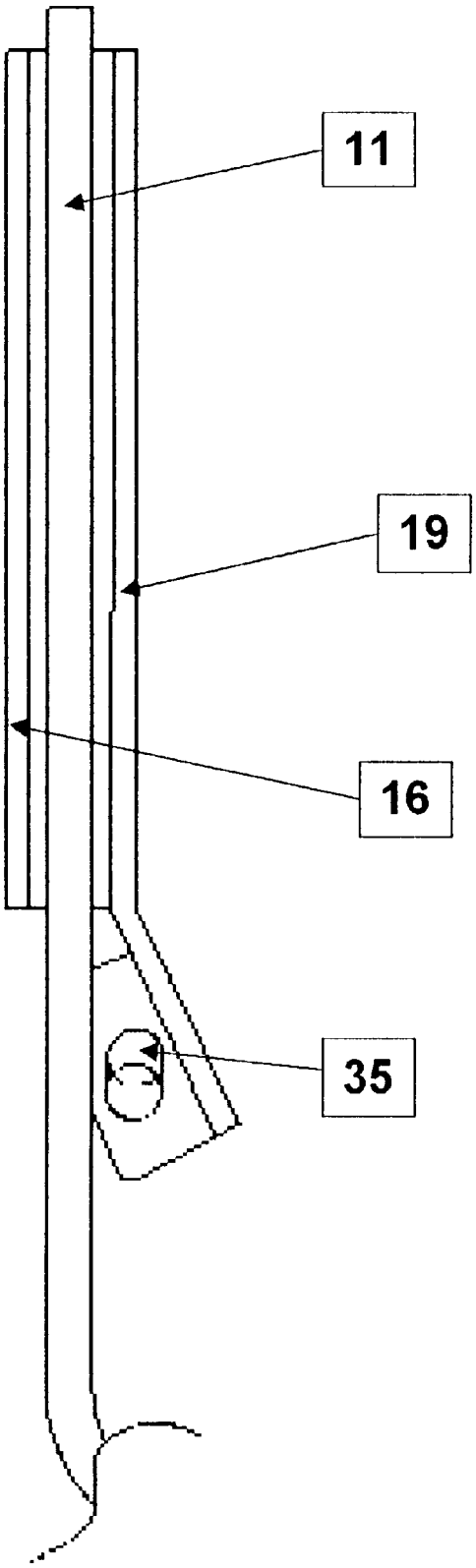
FIG. 3A is a sectional view through the back rest of FIG. 2 with the height adjustment mechanism in the release position.

As earlier described, the rail is secured at its base to the seat which fixes the position of the rail. The back rest of the chair to which the rail collar and the control member are both attached, are on the other hand height adjustable. This is accomplished by rotating the control member 29 such that the orbital portion of the control member is away from the rail as shown in FIG. 3A. In this position, there is nothing to prevent the collar from sliding lengthwise of the vertical portion of the rail. The flexible stop 18 on the back of the collar will not however, under normal circumstances climb upwardly beyond the slot 14 in the rail. This prevents the back rest from inadvertently coming completely off the rail.

Figure 3B:
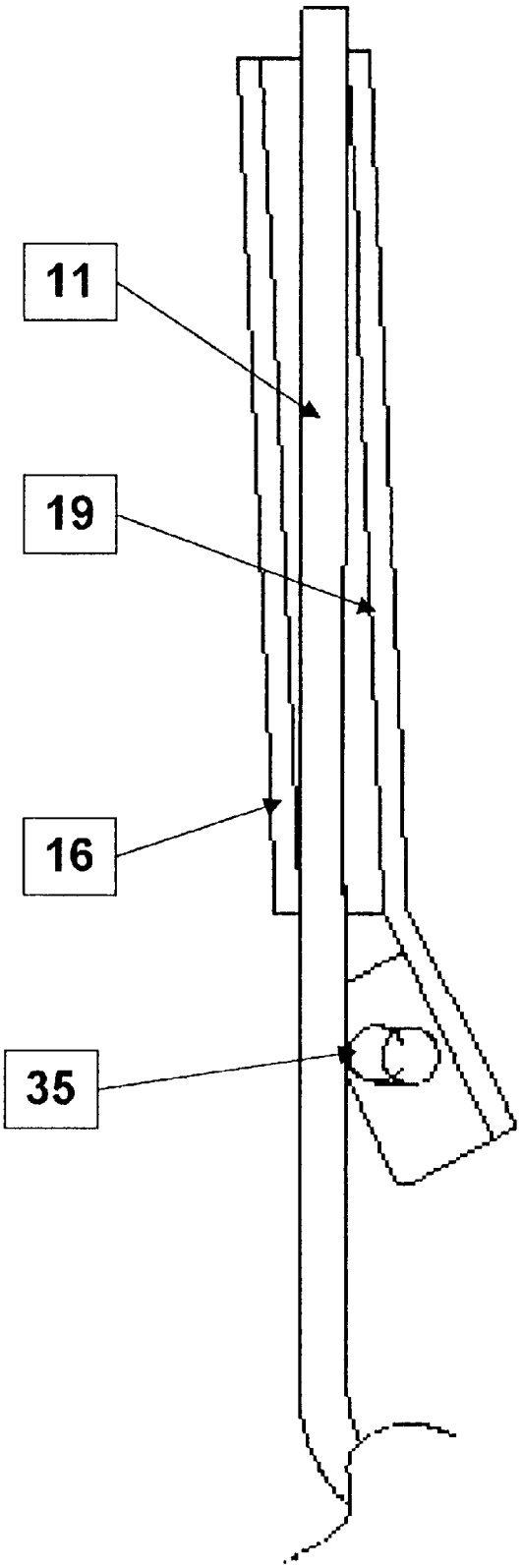
FIG. 3B is a view similar to FIG. 3A but with the height adjustment mechanism in the locking position.

Once the back rest has been adjusted to a desired height, the control member 29 is rotated such that the orbital portion 35 is orbited rearwardly onto the rail as shown in FIG. 3B. This then causes the entire seat to tilt such that the lower portion of the back face of the rail collar is pushed into engagement with the back of the rail while the upper portion of the front face of the rail collar is pushed into engagement with the front face of the rail. The collar therefore has two rail grip regions, one at the back and one at the front of the collar.

Figure 5:
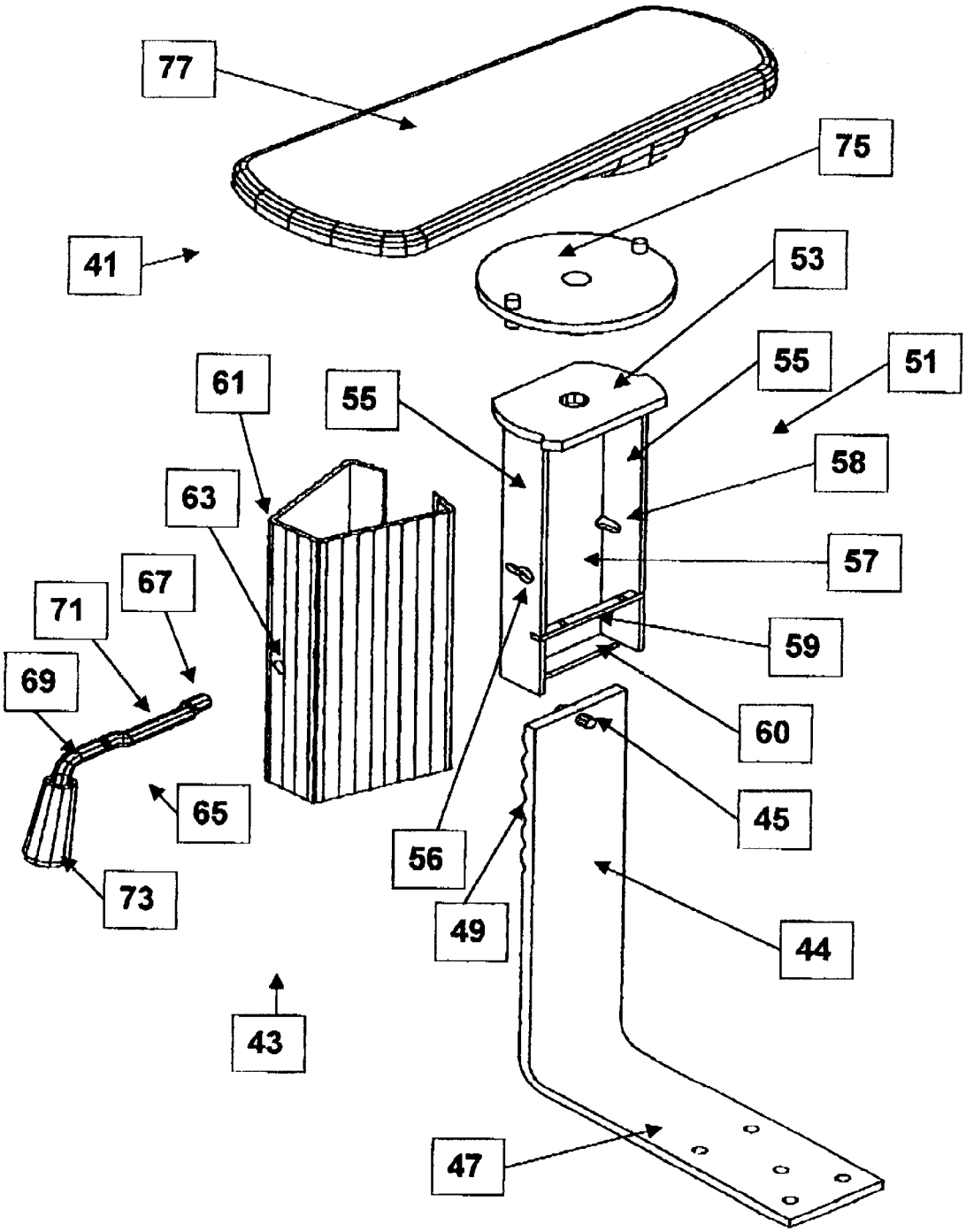
FIG. 5 is an exploded perspective view of the arm rest height adjustment from the chair of FIG. 1.
Figure 6:
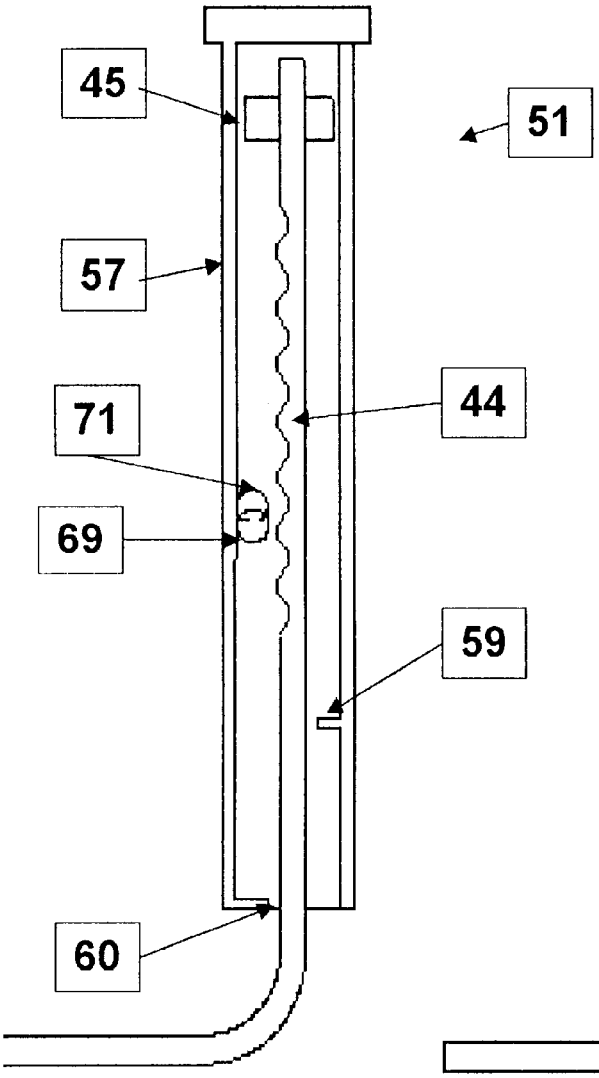
FIG. 6 is a sectional view through the arm rest height adjustment mechanism of FIG. 5 when assembled and in the release position.
Figure 7:
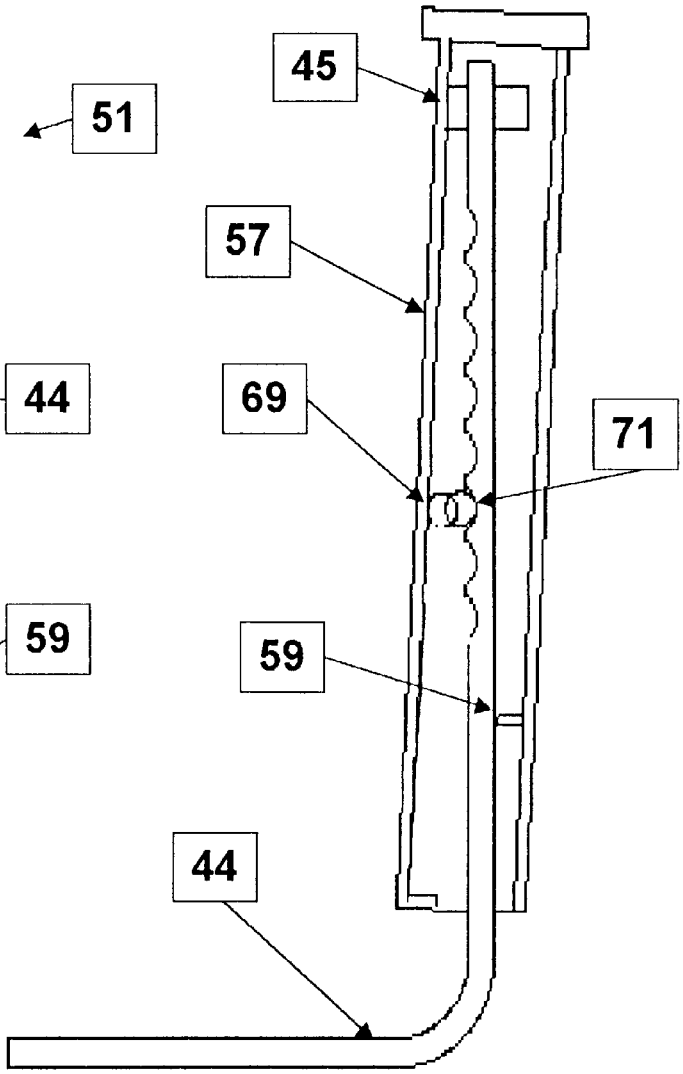
FIG. 7 is a view similar to FIG. 6 but showing the mechanism in the locking position.

FIGS. 5 through 7 show a similar situation at the arm rests of the chair. More particularly, arm rest 41 is provided with a height adjustment mechanism generally indicated at 43. This height adjustment mechanism comprises a rail having a vertical rail portion 44 and a base portion 47 which again attaches to the underside of the chair seat. The vertical portion 44 of the rail is provided to its one side with a ridged surface 49 and a pin 45 located to the upper end of the rail.

A rail collar generally indicated at 51 is sleeved over the vertical rail portion 44. This collar comprises a top plate 53 which secures to an arm rest support 75 attachable to the base of the pad 77 of the arm rest.

The collar further includes a pair of end plates 55, a side plate 57 to one side of the collar with the other side of the collar being open except for the provision of a bar 59.

A cover 61 wraps around the collar. This cover is provided with an opening 63 for receiving a rotatable control member generally indicated at 65. This control member includes a pair of axle portions 67 and 69. Axle portion 67 seats on a stop 58 provided on one of the end plates 55 and axle portion 69 is rotatably trapped after passing through the cover in opening 56 of the other end plate. An orbital portion 71 of the control member is provided between and offset from the two axle portions 67 and 69.

The control member is completed with a handle portion 73 which provides for easy rotation of the control member.

Once again, the rail is in a fixed position and the rail collar to which the arm rest itself is attached is height adjustable relative to the rail. FIG. 6 shows the collar with the control member in the release position which allows height adjustment of the collar in the arm rest. Here it will be seen that the face plate 57 is provided with a bottom lip 60 which in co-operation with the bar 59 of the collar prevents the collar from inadvertently being pulled past the top pin 45 of the rail.

As shown in FIG. 6, the orbital portion 71 of the control member is turned to an up position where it is away from the rail 44. In this position, the collar can be adjusted to different heights relative to the rail.

Once the appropriate height has been chosen, the control member is rotated to the FIG. 7 position where the orbital portion of the control member locks into one of the ridges on the ridged surface 49 of the rail 44. This causes the collar to tip slightly from vertical as shown in FIG. 7 where the bar 59 of the collar grips onto the rail on the rail side opposite the control member. As a result of the pressure applied by the control member directly on the rail and further as a result of the contact pressure between the collar and the rail, the collar is locked against height adjustment in the FIG. 7 position.

The pad of the arm rest can be mounted atop the collar in a somewhat loose fashion or it can be set on an angle that the pad properly seats beneath the users arm even though the collar itself is tipped slightly from vertical.

Figure 8:
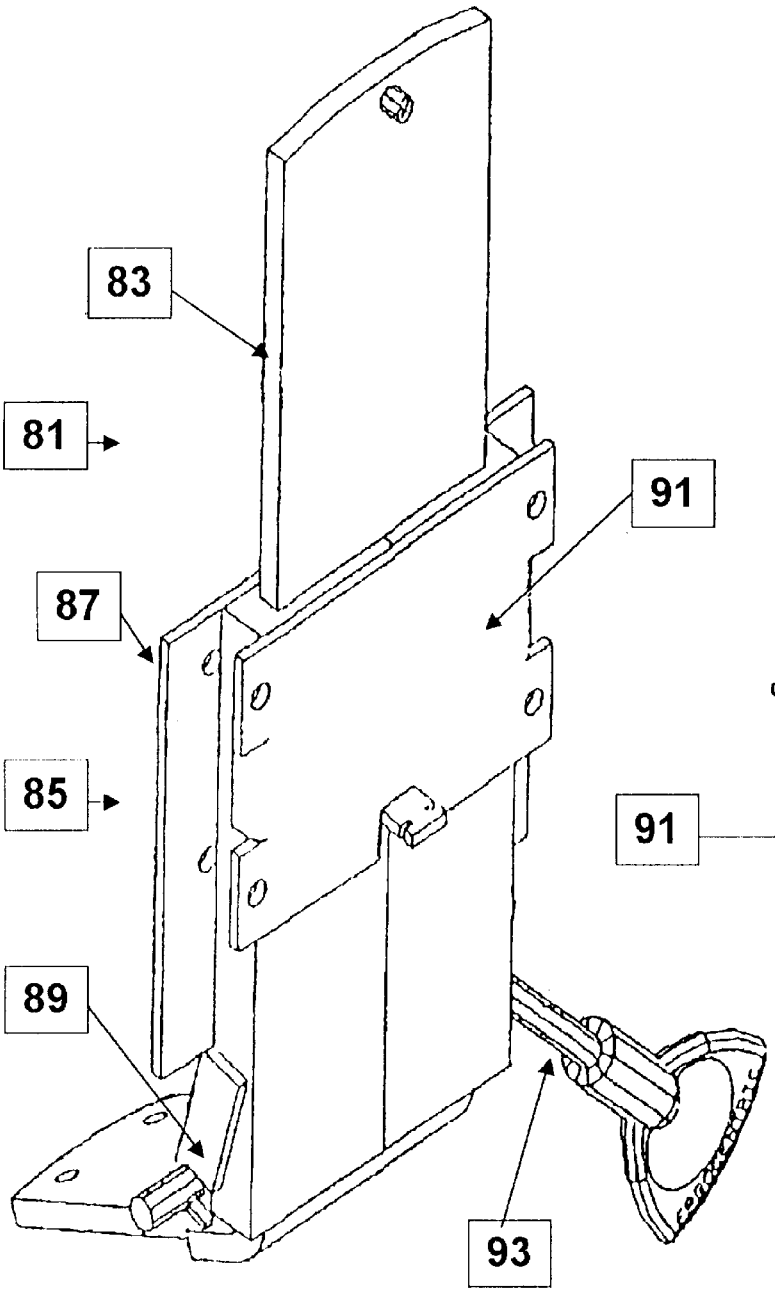
FIG. 8 is a rear perspective view of a chair back rest height adjustment mechanism according to a further preferred embodiment of the invention.
Figure 9:
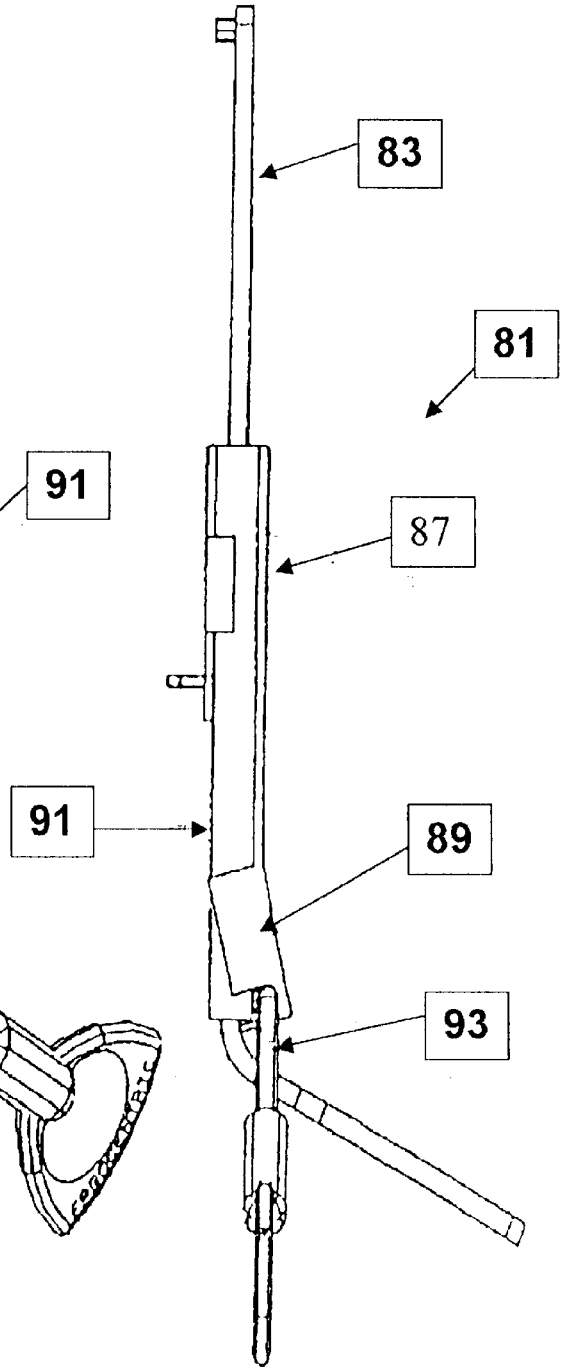
FIG. 9 is a side view of the mechanism shown in FIG. 8.

FIGS. 8 and 9 show a chair back rest height adjustment mechanism generally indicated at 81 and slightly modified from the earlier described back rest mechanism. Mechanism 81 comprises a vertical rail portion 83 with a rail collar generally indicated at 85 sleeved over the vertical rail portion. Collar 85 comprises a front plate 87 having a lower control cover 89 and a rear plate 91. A control member 93 is rotatably held by the control cover 89 of the front face plate. This control member, although not fully shown in FIGS. 8 and 9 is like both of the earlier described control members in that it comprises a pair of axle portions and an orbital portion which is out of the axis of rotation of the control member.

FIG. 9 shows the control mechanism in the unlocking position where the rail collar 85 is aligned with and slideable lengthwise of the rail 83. By rotating the control member through 90°, the orbital portion of the control member engages the rail causing the rail collar to tip and bend on the rail. This locks the rail and rail collar with one another against any further adjustment.

By way of example only, in the embodiments above the rail has been fixed and the rail collar slideable along the rail. It is equally feasible to attach a rail portion to the chair back and to have a rail collar fixed to another part of the chair. In this case, the rail would move with the chair back.

It is also feasible that when the orbital portion of the control member is rotated and bears onto the rail, the rail temporarily deforms from a generally flat surface.

In this manner, the deformed sections of the rail tightly cooperate with the collar, thereby locking the arm rest and back rest in place.

When the orbital portion is rotated away from the rail, the rail returns to its original shape.

Although various preferred embodiments of the present invention have been described in detail, it will be appreciated by those skilled in the art, that variations may be made without departing from the spirit of the invention or the scope of the appended claims.

The embodiments of the invention in which an exclusive property or privilege is claimed are defined as follows:

1. A chair having a mechanism for adjusting height of a component of the chair, said mechanism comprising a vertically extending rail, a rail grip and a rotatable control member, said control member being provided with an orbital portion which upon rotation of said control member orbits between a release position where said rail and said rail grip are slideable relative to one another to adjust the height of the chair component and a locking position where said orbital portion pushes said rail and said rail grip into engagement with one another to lock the chair component against adjustment, wherein said orbital portion of said control member engages said rail when in the locking position, said rail having a ribbed surface for holding said orbital portion of said control member in a fixed position on said rail.

2. A chair having a mechanism for adjusting height of a component of the chair, said mechanism comprising a vertically extending rail, a rail collar sleeved over said rail, a rail grip and a rotatable control member, said control member being provided with an orbital portion which upon rotation of said control member orbits between a release position where said rail and said rail grip are slideable relative to one another to adjust the height of the chair component and a locking position where said orbital portion pushes said rail and said rail grip into engagement with one another to lock the chair component against adjustment, said rail collar being aligned with said rail when said control member is in the release position and being tilted relative to and binding on said rail when said control member is in the locking position.

3. A chair as claimed in claim 2 wherein said control member is located in a vertically spaced relationship to said rail collar sleeve.

4. A chair as claimed in claim 2, wherein said control member comprises a pair of axially aligned axle portions rotatably held by said collar and separated by said orbital portion which is axially offset from said axle portions.

5. A chair as claimed in claim 4 wherein said control member is located in a vertically spaced relationship to said rail collar sleeve.

6. A chair as claimed in claim 2, wherein said rail collar has opposite side surfaces both of which bind on said rail when said mechanism is in the locking position.

7. A chair as claimed in claim 6 wherein said control member is located in a vertically spaced relationship to said rail collar sleeve.

* * * * *